US005353482A

United States Patent [19]

Ziaylek, Jr. et al.

[11] Patent Number: 5,353,482

[45] Date of Patent: Oct. 11, 1994

[54] RELEASABLE LATCHING APPARATUS WITH AN ELECTRICAL ENGAGEMENT MONITORING MEANS

[76] Inventors: Theodore Ziaylek, Jr., 140 Riverview Dr.; Michael P. Ziaylek, 3 Brook La., both of Yardley, Pa. 19067

[21] Appl. No.: 40,773

[22] Filed: Mar. 31, 1993

[51] Int. Cl.[5] ..... A44B 11/00

[52] U.S. Cl. ..... 24/603; 24/643; 24/650

[58] Field of Search ..... 24/603, 650, 651, 641, 24/643, 644, 645, 646, 647

[56] References Cited

U.S. PATENT DOCUMENTS

| | | |
|---|---|---|
| 988,078 | 3/1911 | Carter . |
| 2,029,707 | 2/1936 | Dodehn . |
| 2,271,251 | 1/1942 | Buck . |
| 2,287,721 | 6/1942 | Beazley . |
| 2,458,810 | 1/1949 | Varney et al. . |
| 2,602,977 | 7/1952 | Tannersjo . |
| 2,684,513 | 7/1954 | Morse . |
| 2,710,999 | 6/1955 | Davis . |
| 2,846,745 | 8/1958 | Lathrop . |
| 2,876,516 | 3/1959 | Commings . |
| 2,893,088 | 7/1959 | Harper et al. . |
| 3,049,778 | 8/1962 | Weckesser . |
| 3,050,223 | 8/1962 | Scioloro . |
| 3,090,092 | 5/1963 | Szemplak et al. . |
| 3,133,277 | 5/1964 | Hood . |
| 3,146,846 | 9/1964 | Gutshall . |
| 3,203,064 | 8/1965 | Murphy, Sr. . |
| 3,204,775 | 9/1965 | Smith et al. . |
| 3,313,573 | 4/1967 | Smith et al. . |
| 3,449,714 | 6/1969 | Farley, Jr. . |
| 3,561,160 | 2/1971 | Chan . |
| 3,579,750 | 5/1971 | Fallersleben . |
| 3,643,813 | 2/1972 | Noonan . |
| 3,732,843 | 5/1973 | Pappas et al. . |
| 3,875,556 | 4/1975 | Beaird . |
| 4,023,761 | 5/1977 | Molis . |
| 4,034,697 | 7/1977 | Russell . |
| 4,069,873 | 1/1978 | McClure . |
| 4,339,746 | 7/1982 | Ulicki et al. . |
| 4,342,986 | 8/1982 | Buskirk et al. . |
| 4,408,374 | 10/1983 | Fohl ..... 24/650 |
| 4,477,949 | 10/1984 | Calabro . |
| 4,531,114 | 7/1985 | Topol et al. . |
| 4,624,034 | 11/1986 | Ishiguro et al. . |
| 4,644,616 | 2/1987 | Ferry ..... 24/603 |
| 4,815,177 | 3/1989 | MacKew ..... 24/603 |
| 4,866,594 | 9/1989 | David et al. . |
| 4,905,950 | 3/1990 | Turner et al. . |
| 4,920,619 | 5/1990 | Bender et al. . |
| 5,037,129 | 8/1991 | Fritz et al. . |
| 5,071,100 | 12/1991 | Sweeny . |
| 5,165,498 | 11/1992 | Garboli et al. . |
| 5,185,910 | 2/1993 | Ziaylek, Jr. et al. . |

FOREIGN PATENT DOCUMENTS

| | | |
|---|---|---|
| 70520 | of 1892 | Fed. Rep. of Germany . |
| 21099 | of 1909 | United Kingdom . |

*Primary Examiner*—Victor N. Sakran
*Attorney, Agent, or Firm*—Sperry, Zoda & Kane

[57] ABSTRACT

A releasable latching apparatus having a monitoring means for electrically indicating whether the latching apparatus is in the engaged or disengaged positions. The apparatus includes a main housing with a tab member selectively engageable therewith. A trigger member is pivotally mounted upon a trigger pin which in turn is pivotally mounted in the main housing. The trigger member is selectively engageable with the tab member for engaging or releasing thereof with respect to the main housing. An ejector member is movable between an engagement position and a released position responsive to whether the tab member is engaged to the trigger member. The ejector includes an ejector pin extending outwardly therefrom through an ejector pin opening defined in the main housing to selectively contact the switch lever of a switch which is affixedly secured to the exterior of the main housing. An external switch housing is detachable to extend about the main housing and about the switch means fixedly mounted on the exterior thereof.

18 Claims, 3 Drawing Sheets

FIG. 1
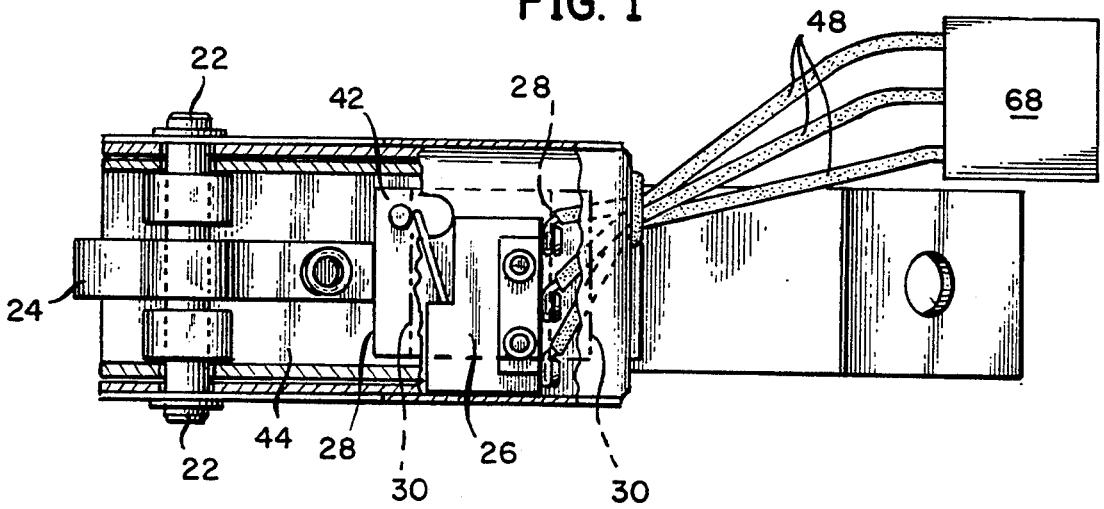
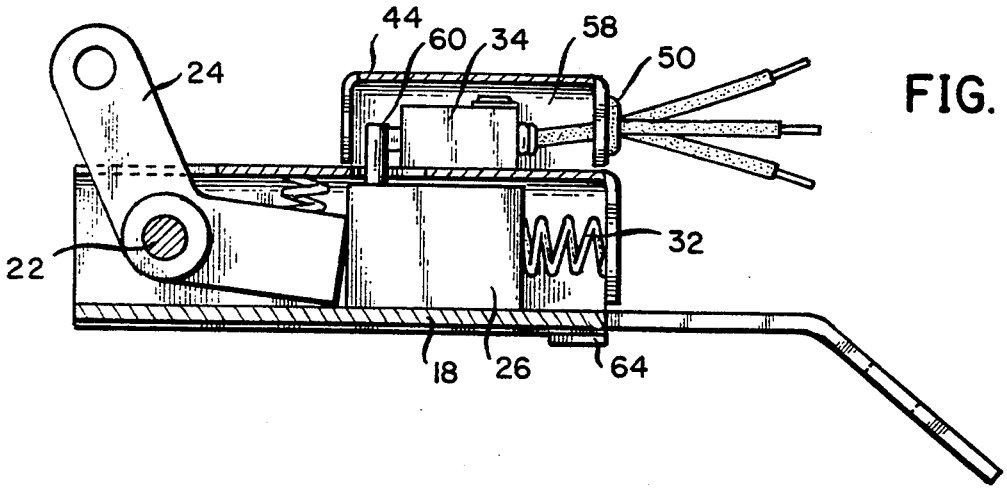
FIG. 2
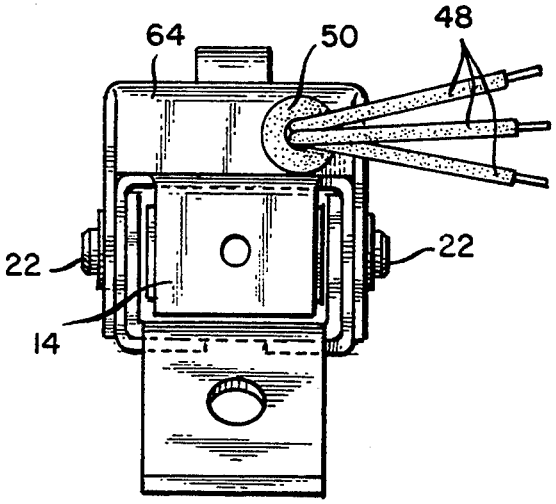
FIG. 3

RELEASABLE LATCHING APPARATUS WITH AN ELECTRICAL ENGAGEMENT MONITORING MEANS

BACKGROUND OF THE INVENTION

1. Field of the Invention

The present invention is particularly designed for monitoring the latching of securement apparatus often utilized with emergency equipment. With emergency vehicles such as fire trucks or the like multiple tanks are often retained with respect to the vehicle. During non-emergency times these tanks are often removed for maintenance or replaced or re-positioned as necessary for normal fire equipment maintenance operations.

It is desirable to provide a means for monitoring the securement of the various tanks utilized as emergency equipment with the fire truck. These tanks normally are used to supply emergency air supply to a firefighter.

The present invention provides an electrical monitoring means for indicating whether all or some of the tanks within a given vehicle are in the proper latched position prior to commencing use of the emergency vehicle under emergency conditions. The design of the present invention includes an indicator means for providing information at the location desired as to whether all of the tanks within a given fire truck are properly latched and in place.

2. Description of the Prior Art

Prior art configurations have been utilized for latching of such tanks and examples of similar types of latching or monitoring designs are shown in U.S. Pat. No. 988,078 patented Mar. 28, 1911 to R. B. Carter on a "Harness Buckler"; and U.S. Pat. No. 2,029,707 patented Feb. 4, 1936 to F. A Dodelin and assigned to Pyrene Manufacturing Company on a "Supporting Bracket For Fire Extinguishers"; and U.S. Pat. No. 2,271,251 patented Jan. 27, 1942 to W. B. Buck on a "Buckle For Belts"; and U.S. Pat. No. 2,287,721 patented Jun. 23, 1942 to H. Beazley on a "Buckle"; and U.S. Pat. No. 2,458,810 patented Jan. 11, 1949 to K. W. Varney et al on an "Aviator's Belt"; and U.S. Pat. No. 2,602,977 patented Jul. 15, 1952 to N. L. Tannersjo and assigned to Gosta Wannstrom on a "Buckle"; and U.S. Pat. No. 2,684,513 patented Jul. 27, 1954 to W. J. Morse and assigned to Morse-Andrews Co. on a "Buckle"; and U.S. Pat. No. 2,710,999 patented Jun. 21, 1955 to F. L. Davis and assigned to Davis Aircraft Products Inc. on a "Quick Releasable Buckle For Safety Belts"; and U.S. Pat. No. 2,846,745 patented Aug. 12, 1958 to W. M. Lathrop and assigned to Cummings & Sander on a "Buckle"; and U.S. Pat. No. 2,876,516 patented Mar. 10, 1959 to L. F. Cummings on a "Buckler"; and U.S. Pat. No. 2,893,088 patented Jul. 7, 1959 to W. W. Harper et al and assigned to Automotive Safety Associates on a "Safety Belt Buckle"; and U.S. Pat. No. 3,049,778 patented Aug. 21, 1962 to E. Weckesser on a "Ratchet Buckler"; and U.S. Pat. No. 3,050,223 patented Aug. 21, 1962 to J. D. Scioloro on a "Holder For Securing Receptacles To The Floor Of A Vehicle"; and U.S. Pat. No. 3,090,092 patented May 21, 1963 to J. C. Szemplak et al and assigned to the United States of American as represented by the Secretary of the Army on a "Double Release Safety Buckle"; and U.S. Pat. No. 3,133,277 patented May 12, 1964 to A. B. Hood on a "Vehicle Seat Belt"; and U.S. Pat. No. 3,146,846 patented Sep. 1, 1964 to J. G. Gutshall on a "Seat Belt Buckle"; and U.S. Pat. No. 3,203,064 patented Aug. 31, 1965 to M. M. Murphy, Sr. and assigned to Irving Air Chute Company, Inc. on a "Safety Belt Buckle"; and U.S. Pat. No. 3,204,775 patented Sep. 7, 1965 to G. L. Smith et al on a "Support For Self-Contained Breathing Apparatus"; and U.S. Pat. No. 3,313,573 patented Apr. 11, 1967 to R. H. Smith et al and assigned to Chrysler Corporation on a "Low Friction Seat Belt Release"; and U.S. Pat. No. 3,449,714 patented Jun. 10, 1969 to N. E. Farley, Jr. and assigned to General Motors Corporation on a "Vehicle Seatbelt Safety System"; and U.S. Pat. No. 3,561,160 patented Feb. 9, 1971 to W. Chan and assigned to Vapor Corporation on a "Crew Switch For Controlling A Door Operator"; and U.S. Pat. No. 3,579,750 patented May 25, 1971 to E. Carbon and assigned to Volkswagen Aktiengesellschaft on a "Lock For Safety Belts"; and U.S. Pat. No. 3,643,813 patented Feb. 22, 1972 to R. Noonan on a "Holder For Pressure Cylinders"; and U.S. Pat. No. 3,732,843 patented May 15, 1973 to M. Pappas et al on an "Intrusion Alarm"; and U.S. Pat. No. 3,875,556 patented Apr. 1, 1975 to J. Beaird on a "Positive Seat Belt Indicator System"; and U.S. Pat. No. 4,023,761 patented May 17, 1977 to J. Molis on an "Adjustable Bracket To Stabilize Upright Compressed Gas Containers Against Displacement On Mobile Vehicles And Ship-Board Installations And Maintenance Shops"; and U.S. Pat. No. 4,034,697 patented Jul. 12, 1977 to W. Russell and assigned to A-T-O Inc. on a "Fire Extinguisher Cabinet"; and U.S. Pat. No. 4,069,873 patented Jan. 24, 1978 to W. McClure on an "Apparatus For Fire Extinguishing System For Floating-Roof Tanks"; and U.S. Pat. No. 4,339,746 patented Jul. 13, 1982 to E. Ulicki et al and assigned to U.S. Philips Corporation on an "Alarm Control Center"; and U.S. Pat. No. 4,342,986 patented Aug. 3, 1982 to A. Buskirk et al and assigned to Honeywell Inc. on a "Central Station Alarm Reporting System"; and U.S. Pat. No. 4,477,949 patented Oct. 23, 1984 to A. Calabro on a "Belt Buckle Construction"; and U.S. Pat. No. 4,531,114 patented Jul. 23, 1985 to P. Topol and assigned to Safety Intelligence Systems on an "Intelligent Fire Safety System"; and U.S. Pat. No. 4,624,034 patented Nov. 25, 1986 to K. Ishiguro et al and assigned to Kabushiki Kaisha Tokai-rika-denki-seisakusho on a "Buckle Apparatus"; and U.S. Pat. No. 4,866,594 patented Sep. 12, 1989 to G. David et al and assigned to Mitel Corp. on a "Gas Cylinder Monitor And Control System"; and U.S. Pat. No. 4,905,950 patented Mar. 6, 1990 to M. Turner et al and assigned to Convenience Marine Products, Inc. on a "Mounting Assembly"; and U.S. Pat. No. 4,920,619 patented May 1, 1990 to R. Bender et al and assigned to Dynamit Nobel Aktiengesellschaft on a "Safety Belt With Integrated Lock Release"; and U.S. Pat. No. 5,037,129 patented Aug. 6, 1991 to E. Fritz et al and assigned to Robert Bosch GmbH on a "Safety Device For Vehicle Occupants"; and U.S. Pat. No. 5,071,100 patented Dec. 10, 1991 to H. Sweeny and assigned to Swenco Limited on a "Multi-Purpose Canister Wall Bracket"; and U.S. Pat. No. 5,165,498 patented Nov. 24, 1992 to O. Garboli et al on an "Electromechanical Device Tripped By A Trigger Box For Both Automatic And Manual Quick-Release For Motorcars Safety Belts"; and U.S. Pat. No. 5,185,910 patented Feb. 16, 1993 to T. Ziaylek, Jr. et al and assigned to T. Ziaylek, Jr. and Michael P. Ziaylek on a "Reversibly Releasable Latching Apparatus"; and British Patent No. 21,099 patented in 1908 to J. Sturm on "Improvements In Or Relating To Locks Or Means Of Producing Locked Connections Of All Kinds"; and German Patent No. 70520 patented Sep. 29, 1892 to R. Kruckel et al.

SUMMARY OF THE INVENTION

The present invention provides a releasable latching apparatus with an electrical engagement monitoring device which includes a tab member defining a tab slot therein. A main housing defines a trigger opening and a tab receiving channel therein. The tab receiving channel is adapted to receive the tab member as well as the tab slot defined therein. The main housing further includes an ejector pin opening therein.

A trigger pin is rotatably mounted in the main housing adjacent the trigger opening. A trigger member is pivotally mounted on this trigger pin in such a manner as to be pivotally movable with respect to the main housing and be positioned extending through the trigger opening thereadjacent. The trigger member is adapted to selectively engage the tab slot of the tab member extending into the tab receiving channel for retaining thereof. The trigger member is responsive to pivotal movement thereof to selectively release engagement with respect to the tab slot.

An ejector member is pivotally mounted within the main housing adjacent the tab receiving channel and is engageable with the tab member extending therein. The ejector member is movable to an engagement position responsive to engagement between the tab slot and the trigger member and is movable to a released position responsive to disengagement between the tab slot and the trigger member.

An ejector biasing means is included positioned between the ejector member and the main housing to urge the ejector to push the tab member out of the tab receiving channel responsive to pivotal movement of the trigger member for disengagement of the trigger member from the tab slot.

A switch which preferably comprises a microswitch is fixedly mounted upon the exterior of the main housing means. This switch includes a switch lever movably mounted thereon. The switch lever is designed to urge the switch means between a first position and a second position having different electrical conditions. The switch lever is positioned adjacent the ejector pin opening defined in the main housing.

An ejector pin is included which is preferably a spring pin being fixedly mounted perpendicularly within the ejector member and extending outwardly through the ejector pin opening parallel to the axis thereof adjacent the switch lever. The ejector pin is selectively capable of being in abutment with respect to the switch lever for urging movement thereof as desired. The switch lever is movable to the first position for urging the switch to be electrically opened responsive to movement of the ejector member to the engagement position. On the other hand the switch lever is movable to the second position urging the switch to be electrically closed responsive to movement of the ejector member to the released position. With this configuration the switch will provide an electrical means of indication as to whether the tab member is engaged with respect to the trigger member.

An external switch housing is included extending about the main housing in such a manner as to define a switch chamber extending around the switch and around the switch lever. The external switch housing is pivotally mounted upon the trigger pin such as to be pivotally movable with respect to the main housing to selectively provide access to the switch and the switch lever. The external switch housing includes a detachable clamping device designed to detachably affix the external switch housing with respect to the main housing as desired. The detachable clamping device preferably includes two struts extending downwardly from the external switch housing and being adapted to extend about the main housing to facilitate detachable securement of the external switch housing therearound. The external switch housing further includes a line opening therein to facilitate electrical communication with respect to the switch. The external switch housing further defines an external opening therein to facilitate direct access to the trigger member therethrough when the external switch housing is in position extending about the main housing.

A plurality of electrical lead lines are designed to be in electrical contact with respect to the switch and are positioned extending through the line opening in the external switch housing. This line opening preferably will include a rubber grommet means therein to protect the electrical lead lines passing through the line opening and through the rubber grommet. A switch securement device preferably comprising a plurality of rivet members are designed to fixedly attach the switch with respect to the main housing. An indicator means may be included in electrical communication with respect to the electrical lead lines and also with respect to the switch in order to provide a means for indicating whether the tab member is or is not in engagement with respect to the trigger member.

It is an object of the present invention to provide a releasable latching apparatus with an electrical engagement monitoring means wherein maintenance costs are minimized.

It is an object of the present invention to provide a releasable latching apparatus with an electrical engagement monitoring means wherein a minimum number of moving parts are utilized.

It is an object of the present invention to provide a releasable latching apparatus with an electrical engagement monitoring means wherein initial capital cost outlay is minimized.

It is an object of the present invention to provide a releasable latching apparatus with an electrical engagement monitoring means wherein reliability and efficiency of attachment is achieved.

It is an object of the present invention to provide a releasable latching apparatus with an electrical engagement monitoring means wherein speed of release of the latching means is significantly enhanced.

It is an object of the present invention to provide a releasable latching apparatus with an electrical engagement monitoring means wherein released failures are minimized.

It is an object of the present invention to provide a releasable latching apparatus with an electrical engagement monitoring means wherein engagement between the releasable members is accurately monitored.

It is an object of the present invention to provide a releasable latching apparatus with an electrical engagement monitoring means wherein engagement between the releasable members is accurately monitored at a remote location.

It is an object of the present invention to provide a releasable latching apparatus with an electrical engagement monitoring means wherein an extremely efficient latching operation can be achieved and monitored by a relatively small electromechanical buckling configuration.

It is an object of the present invention to provide a releasable latching apparatus with an electrical engagement monitoring means wherein disassembly is greatly facilitated to decrease maintenance costs and down time.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

FIG. 1 is a top cross-sectional view of an embodiment of the releasable latching apparatus with electrical engagement monitoring means of the present invention;

FIG. 2 is a side cross-sectional view of the embodiment shown in FIG. 1;

FIG. 3 is an end plan view of the embodiment shown in FIG. 1 as viewed from the right side;

DETAILED DESCRIPTION OF THE PREFERRED EMBODIMENT

Figure 4:
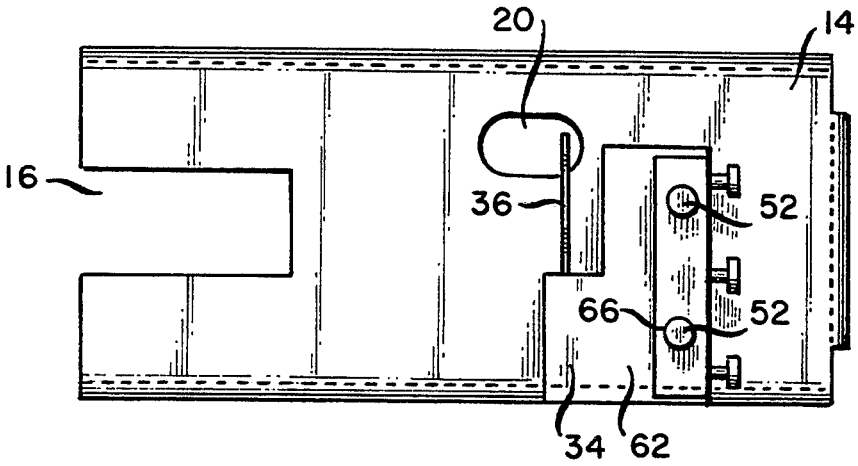
FIG. 4 is top plan view of an embodiment of a main housing of the present invention.
Figure 5:
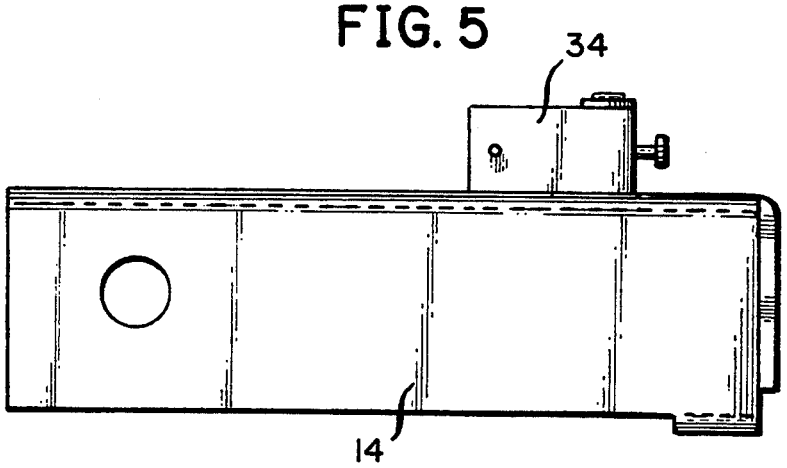
FIG. 5 is a side plan view of the embodiment shown in FIG. 4.
Figure 6:
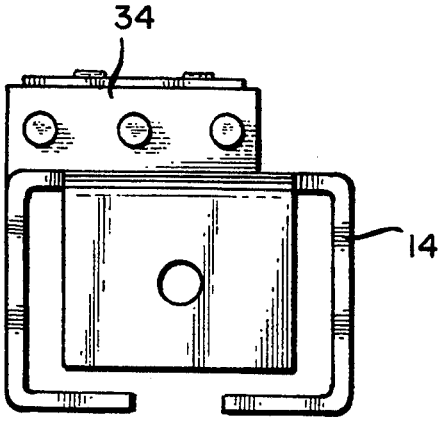
FIG. 6 is an end plan view of the embodiment shown in FIG. 4 as viewed from the right.
Figure 7:
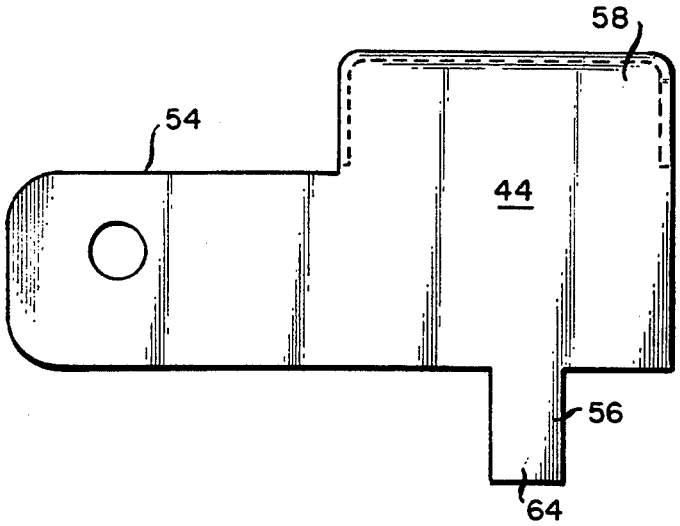
FIG. 7 is a side plan view of an embodiment of the external switch housing of the present invention.
Figure 8:
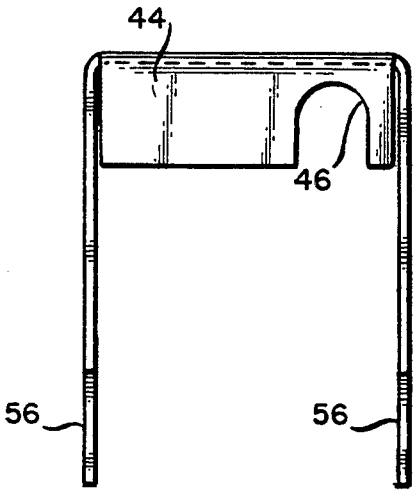
FIG. 8 is an end plan view of the embodiment shown in FIG. 7 from the right.
Figure 9:
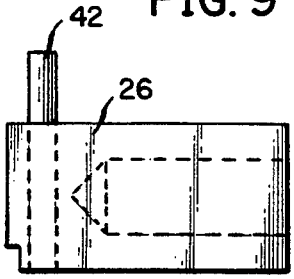
FIG. 9 is a side cross-sectional view of an embodiment of the ejector member and ejector pin of the present invention.
Figure 10:
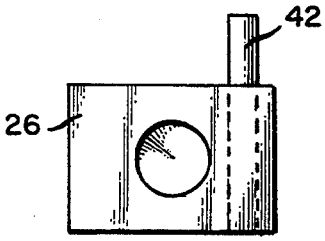
FIG. 10 is an end cross-sectional view of the embodiment shown insecure 9.
Figure 11:
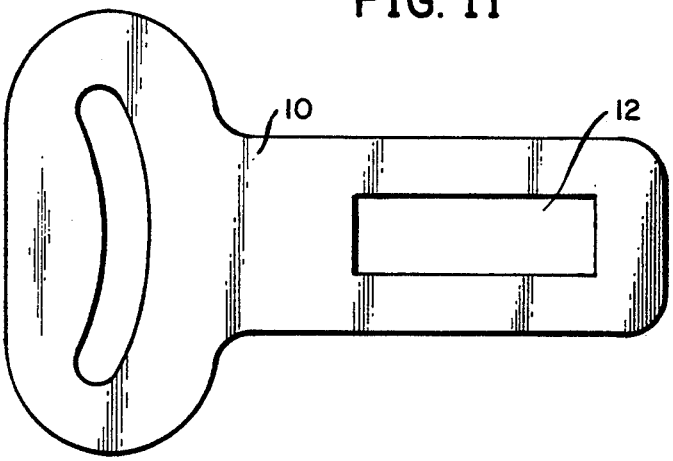
FIG. 11 is a top plan view of an embodiment of a tab member of the present invention.

The present invention provides a main housing 14 defining a tab receiving channel means 18 therein adapted to be detachably engageable with respect to a tab member 10 and in particular with respect to a tab slot 12 defined therein.

A trigger pin 22 is rotatably movable with respect to the main housing 14 and extends therethrough. A trigger member 24 which is generally L-shaped is movably mounted with respect to the trigger pin 22 such as to be pivotally mounted and movable with respect to the main housing 14. The main housing 14 defines a trigger opening 16 therein through which the trigger member 24 extends to provide access thereto while mounted upon the trigger pin 22. The trigger member 24 is adapted to be selectively engageable with respect to the tab slot 12 of the tab member 10. In this manner the trigger member 24 is adapted to detachably secure the tab member 10 with respect to the main housing 14. Pivotal movement of the trigger member 24 will cause selected disengagement of the tab slot 12 from trigger member 24 thereby releasing the tab member 10 from the main housing 14 in a fairly conventional manner.

An ejector member 26 will be movably contained within the main housing 14 and will be movable between a released position 28 and an engagement position 30. An ejector biasing means 32 will tend to urge the ejector member 26 toward the released position 28. The tab member 10 is adapted responsive to entering the tab receiving channel 18 of the main housing 14 to contact the ejector member 26 for movement thereof to the engagement position 30. The tab member 10 will retain the ejector 26 in the engagement position 30 while engaged with the main housing 14. Pivotal movement of the trigger member 24 to release the tab member 10 from the tab receiving channel 14 will allow the ejector member 26 to eject the tab member 10 from the tab receiving channel 18 by movement of the ejector member 26 from the engagement position 30 to the released position 28 responsive to force being urged by the ejector biasing means 32.

The above-identified configuration is similar to the disclosure of the reversible releasing latching apparatus shown in U.S. Pat. No. 5,185,910 issued Feb. 16, 1993 to the inventors herein. The disclosure and claims of that patent are hereby incorporated by reference into the present application.

The present invention further includes an electrical switch means 34 such as a microswitch 62 fixedly secured to the exterior of the main housing 14. Switch 34 is adapted to be secured to the main housing 14 by a switch securement means 52 which may include a securement plate and one or more specific mounting rivets 66 as shown best in FIG. 4. Switch means 34 preferably includes a switch lever 36 which is pivotally movable with respect thereto. Movement of the switch lever 36 will cause the electrical condition of switch means 34 to selectively alternate between being opened and being closed. An ejector pin 42 such as a spring pin 60 or the like is preferably fixedly mounted within the ejector member 26 and is preferably perpendicular with respect thereto. The ejector pin 42 is positioned to extend outwardly through the ejector pin opening means 20 defined in the main housing 14 immediately adjacent the switch lever 36 of switch 34. Preferably the ejector pin 42 extends parallel to the axis of the ejector pin opening 20. The ejector pin 42 is adapted to selectively engage the switch lever 36 responsive to movement of the ejector member 26 between the released position 28 and the engagement position 30 to cause opening and closing of the switch means 34 responsive to movement of the ejector member 26 between these two positions.

An external switch housing 44 is adapted to extend about the main housing 14 and about the switch means 34 and the switch lever 36. This external switch housing will preferably define a switch chamber 58 therein for surrounding of the switch 34 and the switch lever 36. The external switch means is preferably pivotally mounted with respect to the trigger pin 22. In this manner the external switch housing 44 will be pivotally movable with respect to the main housing 14 to provide access thereto for maintenance as desired. The external switch housing 44 will be selectively engageable in position surrounding the main housing 14 by a clamping means 64 which may comprise two downwardly extending strut means 56 which are ear-like members extending downwardly from the external switch housing 44 to allow securement extending about the lower portion of the main housing 14 as shown best in FIG. 2. The main housing will further define an external opening 54 therein to provide access to the trigger member 24 even while the external switch housing 44 is in place surrounding the main housing 14.

A plurality of electrical lead lines 48 will be in electrical communication with respect to the switch means 34 for sensing whether the switch is in the opened or closed position. The external switch housing 44 will define a line opening means 46 in the external surface thereof to facilitate passing of the electrical lines 48 outwardly from the switch means 34 to the exterior thereof. To minimize possible damage to these electrical lines 48 a rubber grommet means 50 is preferably positioned within the line opening 46 with the electrical lines 48 extending through a protected opening therethrough.

These electrical lines lead from the switch means 34 to an external indicator means 68 which may comprise a visual or audio indicator or any other convenient means for providing information as to whether the latching apparatus associated with the electrical switch is properly engaged.

In the preferred configuration of the present invention the switch lever 36 when moved to the first position will cause the switch 34 to be electrically opened. This movement of the switch lever 36 as urged by the ejector pin 42 will be responsive to movement of the ejector member to the engaged position. On the other hand the switch lever 36 when moved to the second position will urge the switch means to be electrically closed which is responsive to movement of the ejector member 26 to the released position. The responsiveness of the respective opened and closed positions of the switch means 34 could obviously be reversed if such an arrangement were deemed to be more useful in regard to the particular indication means used in a specific configuration. In any case it is movement of the ejector member 26 and the ejector pin 42 mounted therein which is responsive to reverse the position of the switch lever 36 and in particular the switch means 34 between the opened and closed position thereof or vice versa.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

I claim:

1. A releasable latching apparatus with an electrical engagement monitoring means comprising:

A. a tab member defining a tab slot means therein;

B. a main housing means defining a trigger opening and a tab receiving channel means therein, said tab receiving channel means adapted to receive said tab member and said tab slot means thereof selectively extending therein, said main housing means further defining an ejector pin opening means therein;

C. a trigger pin means rotatably mounted in said main housing means adjacent said trigger opening defined therein;

D. a trigger member pivotally mounted on said trigger pin means to be pivotally moveable with respect to said main housing means and extending through said trigger opening thereadjacent, said trigger member adapted to selectively engage said tab slot means of said tab member extending into said tab receiving channel means for retaining thereof, said trigger member being responsive to pivotal movement thereof to selectively release engagement with respect to said tab slot means;

E. an ejector member movably positioned within said main housing means adjacent said tab receiving channel means and engageable with a tab member extending therein, said ejector member being movably to an engagement position responsive to engagement between said tab slot means and said trigger member and being moveable to a released position responsive to disengagement between said tab slot means and said trigger member;

F. an ejector biasing means positioned between said ejector member and said main housing means to urge said ejector means to push said tab member out of said tab receiving channel means responsive to pivotal movement of said trigger member for disengagement of said trigger member from said tab slot means;

G. a switch means fixedly mounted upon the exterior of said main housing means, said switch means including a switch lever means movably mounted thereon, said switch lever means being moveable to urge said switch means between a first position and second position, said switch lever means being positioned adjacent said ejector pin opening means defined in said main housing means;

H. an ejector pin means fixedly mounted in said ejector member and extending through said ejector pin opening means adjacent said switch lever means, said ejector pin means being selectively in abutment with respect to said switch lever means for urging movement thereof, said switch lever means being moveable to the first position responsive to movement of said ejector member to the engagement position, said switch lever means being moveable to the second position responsive to movement of said ejector member to the released position, said switch means providing indication of whether said tab member is engaged with respect to said trigger member; and I. an external switch housing means extending about said main housing and around said switch means and said switch lever means, said external switch housing means being pivotally mounted upon said trigger pin means to be pivotally movably with respect to said main housing means to selectively provide access to said switch means and said switch lever means, said external switch housing means including a detachable clamping means to detachable affix said external switch housing means with respect to said main housing means, said external switch housing means further defining a line opening means therein to facilitate electrical communication with respect to said switch means therein.

2. A releasable latching apparatus with an electrical engagement monitoring means as defined in claim 1 further comprising a plurality of electrical lines in electrical communication with respect to said switch means and extending through said line opening means defined in said external switch housing means.

3. A releasable latching apparatus with an electrical engagement monitoring means as defined in claim 2 further comprising a grommet means positioned within said line opening means to protect said electrical lines passing therethrough.

4. A releasable latching apparatus with an electrical engagement monitoring means as defined in claim 3 wherein said grommet means is of rubber.

5. A releasable latching apparatus with an electrical engagement monitoring means as defined in claim 1 wherein said ejector pin means is oriented extending perpendicularly with respect to said ejector member and said ejector pin opening means.

6. A releasable latching apparatus with an electrical engagement monitoring means as defined in claim 1 further comprising a switch securement means adapted to fixedly secure said switch means to said main housing means.

7. A releasable latching apparatus with an electrical engagement monitoring means as defined in claim 1 wherein said external switch housing means defines an external opening therein to facilitate access to said trigger member therethrough.

8. A releasable latching apparatus with an electrical engagement monitoring means as defined in claim 1 wherein said clamping means includes strut means extending downwardly from said external switch housing means and adapted to extend about said main housing means to facilitate detachable securement of said external switch housing means therearound.

9. A releasable latching apparatus with an electrical engagement monitoring means as defined in claim 1 wherein said external switch housing means defines a switch chamber adapted to extend about said switch means and said switch lever means.

10. A releasable latching apparatus with an electrical engagement monitoring means as defined in claim 1 wherein said switch means is in the opened position responsive to said switch lever means being in the first position and said ejector member being in the engagement position.

11. A releasable latching apparatus with an electrical engagement monitoring means as defined in claim 1 wherein said switch means is in the closed position responsive to said switch lever means being in the second position and said ejector member being in the released position.

12. A releasable latching apparatus with an electrical engagement monitoring means as defined in claim 1 wherein said ejector pin means comprises a spring pin.

13. A releasable latching apparatus with an electrical engagement monitoring means as defined in claim 1 wherein said switch means comprises a microswitch.

14. A releasable latching apparatus with an electrical engagement monitoring means as defined in claim 1 wherein said ejector means is made of aluminum.

15. A releasable latching apparatus with an electrical engagement monitoring means as defined in claim 1 further comprising an indicator means in electrical communication with respect to said switch means to indicate whether said tab member is engaged with said trigger member.

16. A releasable latching apparatus with an electrical engagement monitoring means as defined in claim 15 wherein said indicator means is a visible indicator.

17. A releasable latching apparatus with an electrical engagement monitoring means as defined in claim 15 wherein said indicator means in an audible indicator.

18. A releasable latching apparatus with an electrical engagement monitoring means comprising:

A. a tab member defining a tab slot means therein;

B. a main housing means defining a trigger opening and a tab receiving channel means therein, said tab receiving channel means adapted to receive said tab member and said tab slot means thereof selectively extending therein, said main housing means further defining an ejector pin opening means therein;

C. a trigger pin means rotatably mounted in said main housing means adjacent said trigger opening defined therein;

D. a trigger member pivotally mounted on said trigger pin means to be pivotally moveable with respect to said main housing means and extending through said trigger opening thereadjacent, said trigger member adapted to selectively engage said tab slot means of said tab member extending into said tab receiving channel means for retaining thereof, said trigger member being responsive to pivotal movement thereof to selectively release engagement with respect to said tab slot means;

E. an ejector member movably positioned within said main housing means adjacent said tab receiving channel means and engageable with a tab member extending therein, said ejector member being movably to an engagement position responsive to engagement between said tab slot means and said trigger member and being moveable to a released position responsive to disengagement between said tab slot means and said trigger member;

F. an ejector biasing means positioned between said ejector member and said main housing means to urge said ejector means to push said tab member out of said tab receiving channel means responsive to pivotal movement of said trigger member for disengagement of said trigger member from said tab slot means;

G. a switch means comprising a microswitch fixedly mounted upon the exterior of said main housing means, said switch means including a switch lever means movably mounted thereon, said switch lever means being moveable to urge said switch means between a first position and second position, said switch lever means being positioned adjacent said ejector pin opening means defined in said main housing means;

H. an ejector pin means comprising a spring pin means being fixedly mounted perpendicularly within said ejector member and extending perpendicularly through said ejector pin opening means adjacent said switch lever means, said ejector pin means being selectively in abutment with respect to said switch lever means for urging movement thereof, said switch lever means being moveable to the first position urging said switch means to be electrically open responsive to movement of said ejector member to the engagement position, said switch lever means being moveable to the second position urging said switch means to be electrically closed responsive to movement of said ejector member to the released position, said switch means being indicative of whether said tab member is engaged with respect to said trigger member;

I. an external switch housing means extending about said main housing and defining a switch chamber extending around said switch means and said switch lever means, said external switch housing means being pivotally mounted upon said trigger pin means to be pivotally movably with respect to said main housing means to selectively provide access to said switch means and said switch lever means, said external switch housing means including a detachable clamping means to detachable affix said external switch housing means with respect to said main housing means, said detachable clamping means including strut means extending downwardly from said external switch housing and adapted to extend about said main housing means to facilitate detachable securement of said external switch housing means therearound, said external switch housing means further defining a line opening means therein to facilitate electrical communication with respect to said switch means therein, said external switch housing means defining an external opening therein to facilitate access to said trigger member therethrough;

J. a rubber grommet means positioned within said line opening means;

K. a plurality of electrical lead lines in electrical contact with respect to said switch means and positioned extending through said line opening means and through said rubber grommet means;

L. switch securement means comprising rivet members fixedly attaching said switch means to said main housing means; and M. an indicator means in electrical communication with respect to said electrical lead lines and also with respect to said switch means to indicate whether said tab member is engaged with said trigger member.

* * * * *